US006154936A

United States Patent [19]

Howell et al.

[11] Patent Number: 6,154,936

[45] Date of Patent: Dec. 5, 2000

[54] TWO-PIECE QUICK RELEASE BUCKLE AND STRAP ADJUSTER

[75] Inventors: Frank A. Howell, Oxford; Clarence F. Howell, Bridgton, both of Me.

[73] Assignee: Down East, Inc., Bridgton, Mass.

[21] Appl. No.: 09/217,145

[22] Filed: Dec. 21, 1998

[51] Int. Cl.[7] ..... A44B 11/25

[52] U.S. Cl. ..... 24/625; 24/615; 24/647; 24/664

[58] Field of Search ..... 24/625, 633, 614, 24/615, 635, 664, 588, 647

[56] References Cited

U.S. PATENT DOCUMENTS

| | | | |
|---|---|---|---|
| 2,933,795 | 4/1960 | Meeker | 24/647 |
| 3,212,152 | 10/1965 | Tanaka et al. | 24/647 |
| 4,688,337 | 8/1987 | Dillner et al. | 24/615 |
| 4,864,700 | 9/1989 | Kasai | 24/625 |
| 4,894,890 | 1/1990 | Kasai | 24/625 |
| 4,924,562 | 5/1990 | Pogharian | 24/664 |
| 4,945,614 | 8/1990 | Kasai | 24/615 |
| 5,311,649 | 5/1994 | Suh | 24/635 |
| 5,832,573 | 11/1998 | Howell | 24/664 |

*Primary Examiner*—Victor N. Sakran
*Attorney, Agent, or Firm*—Samuels, Gauthier & Stevens

[57] ABSTRACT

A two-piece lanyard release buckle which comprises a keeper and a secure part. The keeper is comprised of a floor which includes a front portion and a rear portion and a cover spaced apart from the floor, means for flexibly securing the cover and the floor to one another and a lanyard secured to the cover. The opposed surfaces of the floor and the cover define a slot therebetween and a keeper surface is formed on the surface of the cover. The secure part is configured to be received in the slot and is comprised of a front portion and a rear portion. The secure part is characterized by at least one locking finger having a top surface and terminating in a catch tab. When the secure part is received in the keeper, the locking finger engages the keeper surface and locks the secure part to the keeper. To unlock the buckle, the lanyard is pulled and the keeper surface moves, substantially unimpeded, upwardly over the plane of the top surface of the locking finger thereby releasing the keeper surface from the locking finger.

12 Claims, 5 Drawing Sheets

TWO-PIECE QUICK RELEASE BUCKLE AND STRAP ADJUSTER

BACKGROUND OF THE INVENTION

1. Field of the Invention

The invention relates to quick release buckles for backpacks and the like.

2. Description of the Relevant Art

Web straps on light weight backpacks, rucksacks and hiking packs typically use "side-action" buckles to allow shoulder, compression and/or large pocket straps to be parted. This side-action buckle design has significant limitations when used in this capacity. The release tabs are recessed onto the sides of the buckle so they can be difficult to find and release when hurried or when wearing winter gloves. Both release tabs must be squeezed simultaneously toward each other to part the buckle. The hand force required to push the halves together and lock them cannot be increased/decreased without a proportional impact on the hand force required to unlock them. When separated, the exposed locking tabs of the male-half (tongue) of the buckle can be easily broken off and the female-half (body) can be crushed if stepped on.

SUMMARY OF THE INVENTION

The present invention embodies an inexpensive, two-piece buckle that can be conveniently opened even while hurried or wearing winter gloves. The buckle can be opened with the natural, intuitive upward pulling action. The forces required to lock and release the buckle are independently controlled. The buckle is durable even when the two interlocking halves are separated.

Broadly the invention, in one embodiment, comprises a two-piece lanyard release buckle including a keeper and a secure part. The keeper has a floor which includes a front portion and a rear portion. A cover is spaced apart from the floor, the opposed surfaces of the floor and cover defining a slot therebetween. A keeper surface is formed on one of the opposed surfaces of either of the floor or the cover. The floor and cover are flexibly secured one to the other. A lanyard is secured to the cover.

The secure part is configured to be received in the slot. The secure part has a front portion and a rear portion. The secure part is characterized by at least one locking finger extending from the rear portion to the front portion whereby as the secure part is received in the keeper, the secure part travels along a first axis, the locking finger engages the keeper surface and locks the secure part to the keeper. When the buckle is unlocked the lanyard is pulled upwardly. The keeper surface travels along a second axis distinct from the first axis to release the keeper surface from the locking finger thereby unlocking the buckle.

In another embodiment of the invention, a strap adjustment locking system is joined to either the rear portion of the keeper and/or secure part, preferably to the rear portion of the keeper. The system comprises side walls extending from the rear portion, which side walls terminate in an access wall. The access wall is characterized by a slot. Top and bottom plates each characterized by openings in registration with one another, are joined to the side wall. The access wall, side walls and top and bottom plates define a chamber. A clamping bar is received in the system. A strap passes through the slot around the clamping bar and back through the slot. The clamping bar with the attached strap is adapted to reciprocate in the chamber between a locked position where the clamping bar and strap are frictionally engaged to the system and an adjustment position where the clamping bar is spaced apart from the access wall whereby the strap may be adjusted. The openings in the plates facilitate the threading of the strap through the system and the movement of the strap when the strap is being adjusted.

In still another embodiment of the invention, positive ejection of the secure part from the keeper is effected. A spring tab is formed in the cover of the keeper. When the secure part is locked in the keeper, a guide rail on the secure part flexes the spring tab resulting in the secure part being locked to the keeper part under tension. When the cover of the keeper is lifted, releasing the locking finger, the spring tab ejects the secure part.

In the preferred embodiment of the invention, all just described embodiments are combined.

In a particularly preferred embodiment, the locking system is joined to the rear portion of the keeper and the cover is flexible.

DESCRIPTION OF THE PREFERRED EMBODIMENT(S)

Figure 1:
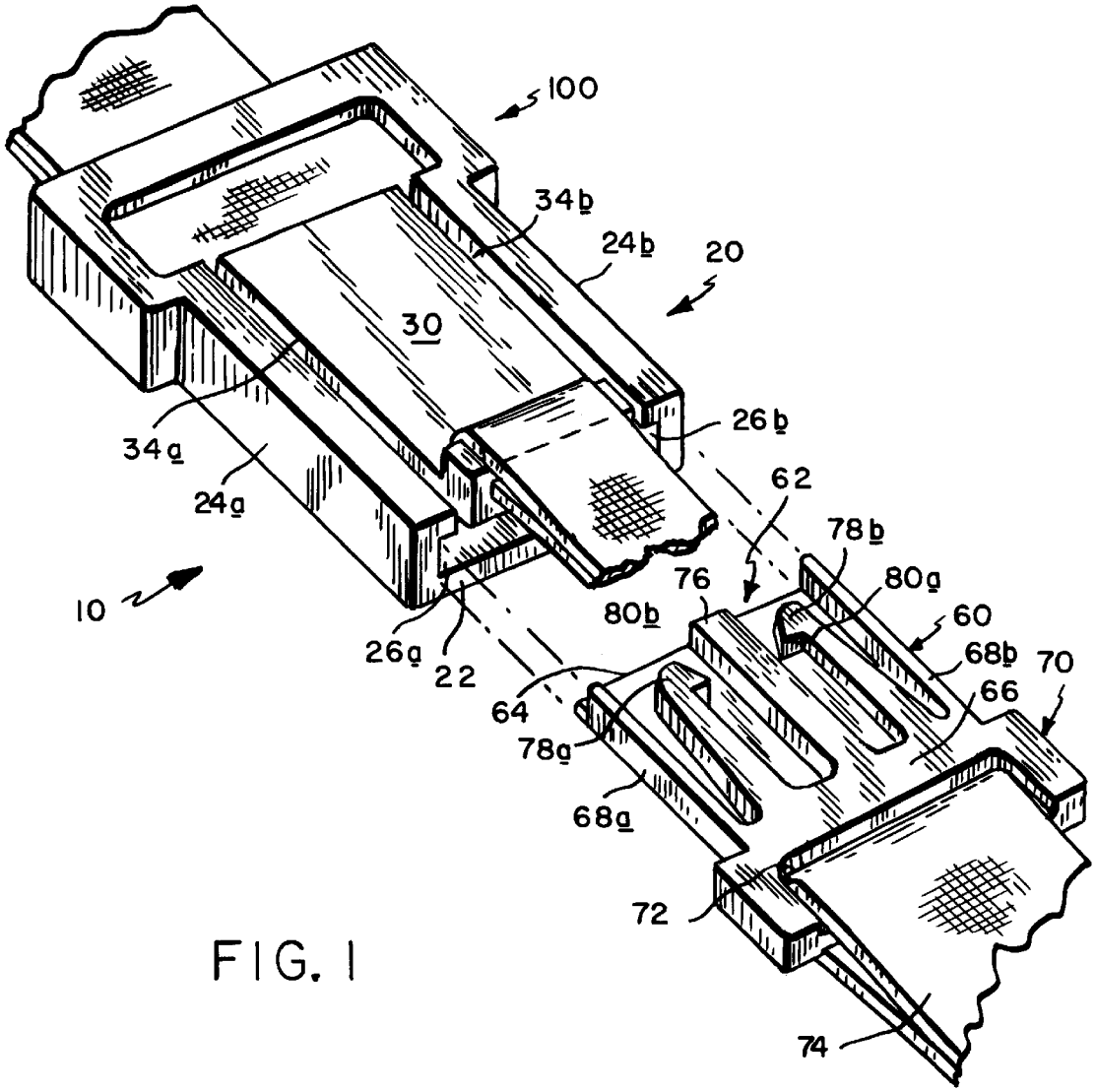
FIG. 1 is a telescopic perspective view of a buckle embodying the invention.
Figure 4:
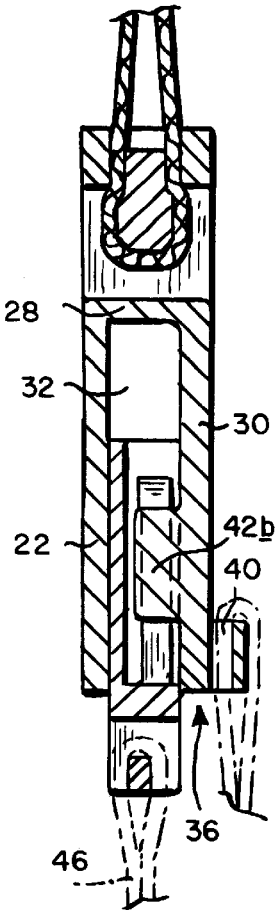
FIG. 4 is a side view of FIG. 3.
Figure 3:
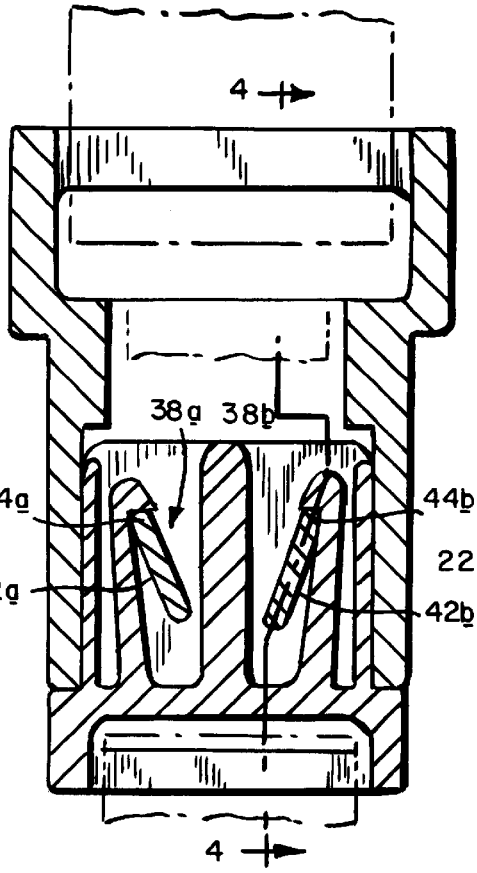
FIG. 3 is a top view, partly broken away, of the secure part received in the keeper.
Figure 5:
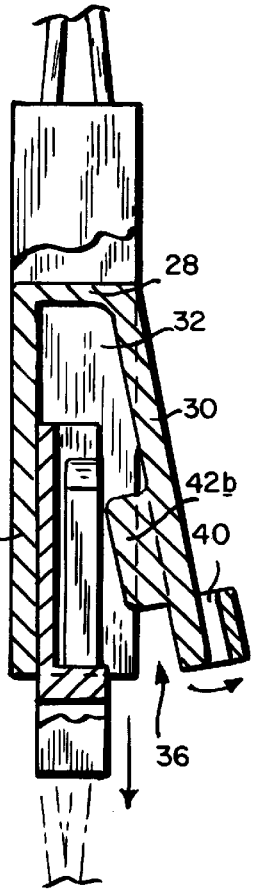
FIG. 5 is a side view, partly broken away, of the secure part releasing from the keeper.
Figure 2:
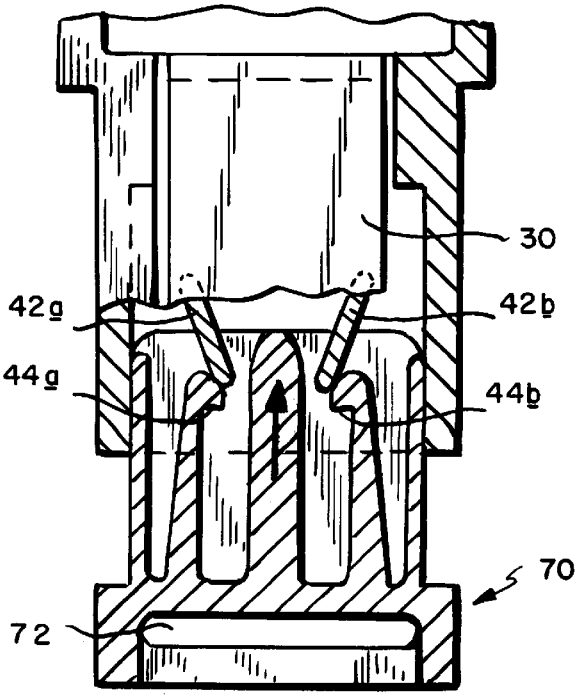
FIG. 2 is a top view, partly broken away, of the secure part of the buckle being inserted into a keeper part of the buckle.
Figure 6:
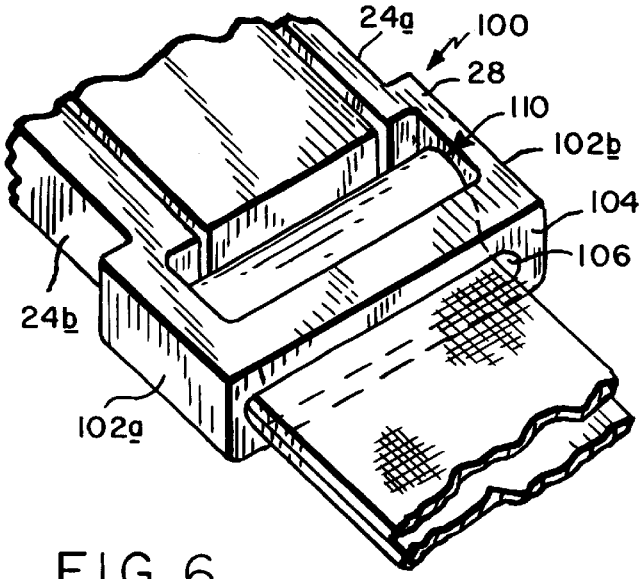
FIG. 6 is a perspective view of a web-strap adjustment system of the buckle of the invention.
Figure 7:
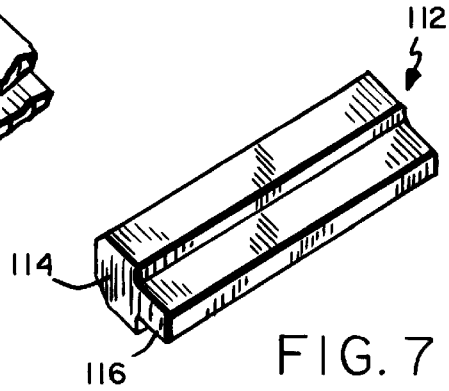
FIG. 7 is a perspective view of a locking bar.

Referring to FIGS. 1–5, a buckle 10 embodying the invention is shown and comprises a keeper 20 and a secure part 60. In the preferred embodiment, the buckle 10 includes a strap adjustment locking system 100.

The keeper 20 includes a floor 22, opposed walls 24*a* and 24*b*, each wall 24*a* and 24*b*is characterized by a slot 26*a* and 26*b* respectively. A back wall 28 extends from the floor 22. A cover 30 is flexibly joined to the back wall 28 and extends over and is spaced apart from the floor 22 to form a socket 32. The cover 30 has edges 34*a* and 34*b* spaced apart from the walls 24*a* and 24*b*. The cover 30 has a leading edge 36 characterized by a slot 40. A lanyard 46, FIG. 4, passes through the slot 40. The underside of the cover 30 has mirror image keeper ribs 38*a* and 38*b*, the keeper ribs 38 having guide surfaces 42*a* and 42*b* and keeper surfaces 44*a*and 44*b*.

The secure part 60 comprises a floor 62 having a leading edge 64 and a rear wall 66 and side walls 68*a* and 68*b*. Extending from the rear wall 66 is a housing 70 characterized by a slot 72. A strap 74 passes through the slot 72 as shown. Extending forwardly from the rear wall 66 and toward leading edge 62 is a guide rail 76 and two flexible locking fingers 78*a* and 78*b*. The fingers 78*a* and 78*b* terminate in catch tabs 80*a* and 80*b* respectively.

Referring to FIGS. 1–4, as the keeper 20 and secure part 60 are pressed together, the opposed locking fingers 78 on the secure part 60 are flexed outwardly toward the sides of the secure part 60 by the guide surfaces 42 of the ribs 38 on the keeper 20. The guide rail 76 on the secure part 60 slides between the ribs 38 in the keeper 20 to align the keeper 20 and secure part 60. The keeper 20 and the secure part 60 lock together when the fingers 78 snap past the keeper surfaces 44 and the catch tabs 80 engage or lock to the keeper surfaces 44.

The buckle 10 is released when the lanyard 46 attached to the cover 30 of the keeper 20 is pulled upwardly and flexes the keeper surfaces 44 out of alignment with the catch tabs 80. Because the locking fingers 78 flex on the horizontal plane of the buckle 10 and the cover 30 flexes vertically (90 degrees offset), the force required to insert and lock the buckle is completely independent of the force required to release the buckle. The insertion/retention force can be adjusted by the stiffening or softening the flexing action of the fingers 78 while release action can be adjusted by stiffening or softening the flexing section of the cover 30. This important attribute allows the locking/load-bearing and release actions to be independently adjusted to the demands of a particular application. For example, it is possible to design the buckle to produce a stiff locking, high load-bearing capability while maintaining a light release action, or vice versa.

Although shown with reference to a specific configuration, the cover 30 can be made of a rigid material and spring loaded to provide the desired flexibility. The fingers 78 can also be stiff and spring loaded if desired. A single finger 78 and keeper surface 44 can be used rather than two. Also, the position of the fmgers and keeper surface can be reversed.

Further, unlike the side-action prior art designs, the locking fmgers are protected. The guide rail 76 and raised sides 68 restrain the locking fingers 78 from movement beyond their breaking point. Further, unlike the prior art side-action designs, the keeper 20 cannot be crushed easily because pressure on the flexing cover 30 section will bend it slightly downward until the ribs 38 contact the floor 22.

Normally pulling on the lanyard will also place the fingers 78 under load and cause the buckle 10 to part when the cover 30 flexes out of alignment with the fingers 78. If the keeper 20 and secure part 60 are not under tension when released, positive ejection of the secure part 60 from the keeper 20 is desired.

Figure 10:
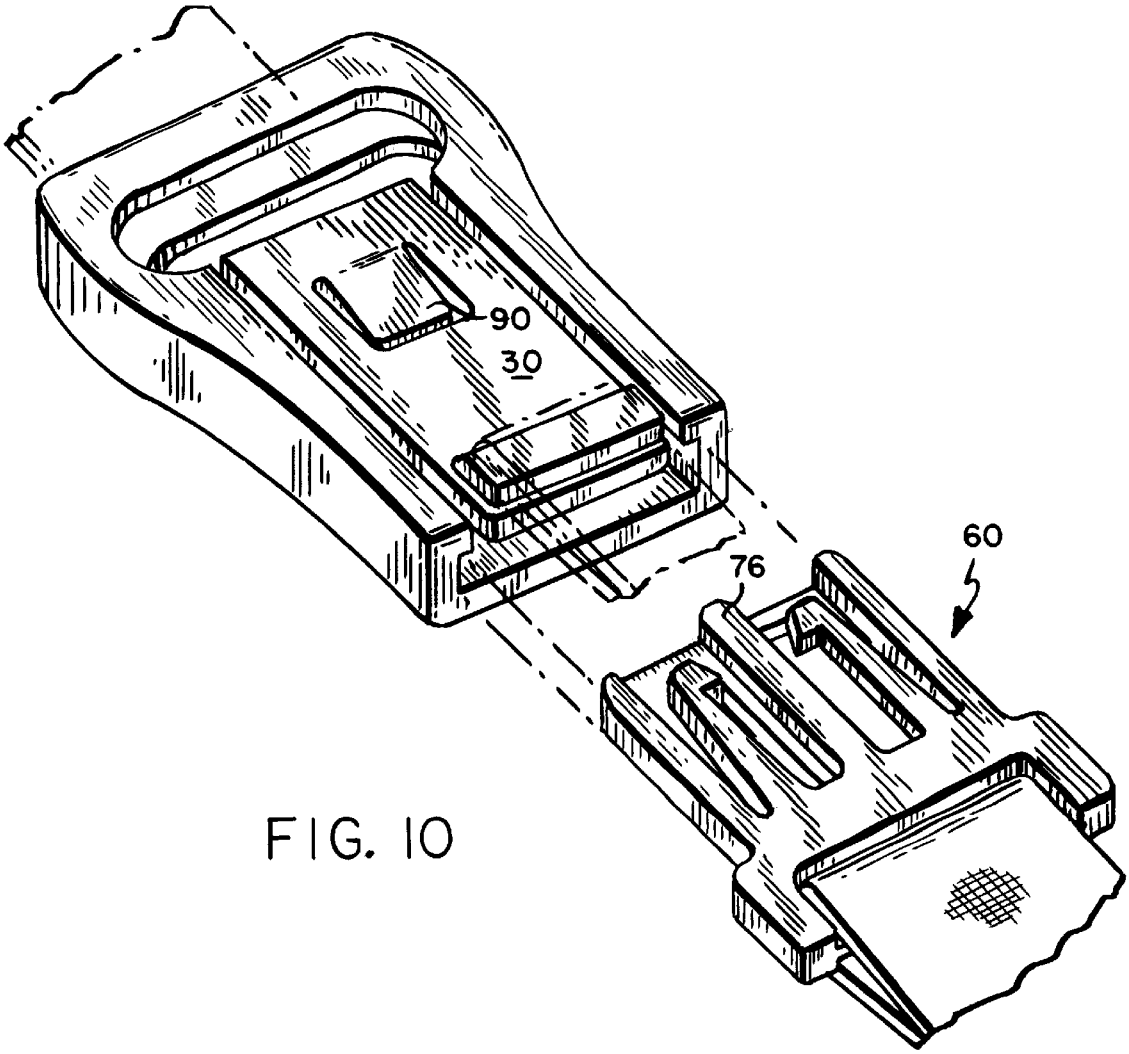
FIG. 10 is a perspective view of an alternative embodiment of the invention.
Figure 11:
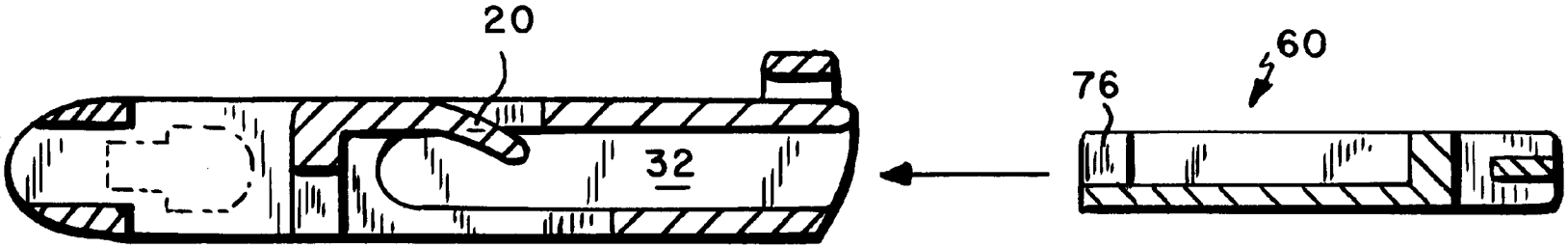
FIG. 11 is a side sectional view of FIG. 10.
Figure 12:
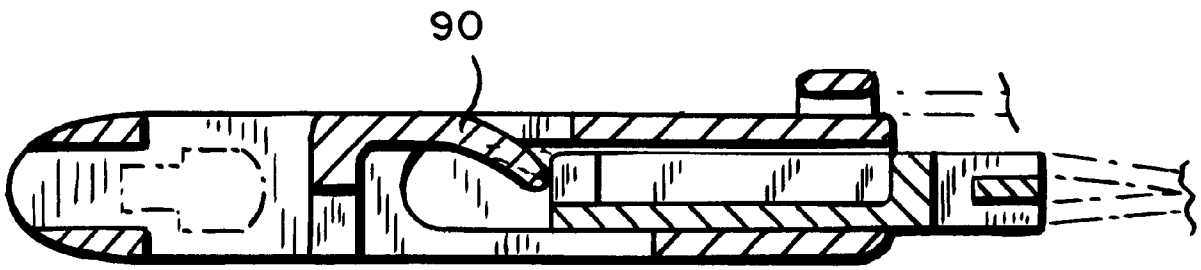
FIG. 12 is a side sectional view of FIG. 10.

In a further embodiment of the invention, referring to FIGS. 10, 11 and 12, the cover 30 is characterized by a spring tab 90, which extends into the socket 32. When the secure part 60 slides into the socket 32, in addition to the locking action previously described, the end of the guide rail 76 engages and flexes (loads) the spring tab 90 such that both the spring tab 90 and guide rail 76 are engaged under tension. When the buckle 10 is unlocked (as described above) the spring tab flexes driving the guide rail 76 to facilitate the disengagement of the secure part 60 from the keeper 20.

Referring to FIGS. 1, 6, 7, 8 and 9, extending rearwardly from the wall 28 is a strap adjustment/locking system 100. The system 100 comprises walls 102*a* and 102*b* joined at one end to the wall 28 of the keeper 20 and at the other end to an access wall 104 having a slot 106 formed therein. Upper and lower access openings 108*a* and 108*b* in registration with one another are formed in the system 100. The walls 28, 102*a* and 102*b* and 104 define a chamber 110.

A moveable clamping bar 112 is slidably received in the chamber 110 and can pass freely through the slot 106. The bar 112 comprises a chamfered section 114 and a tongue 116. A strap 118 is threaded through the slot 106 and around the bar 112 as shown.

Figure 8:
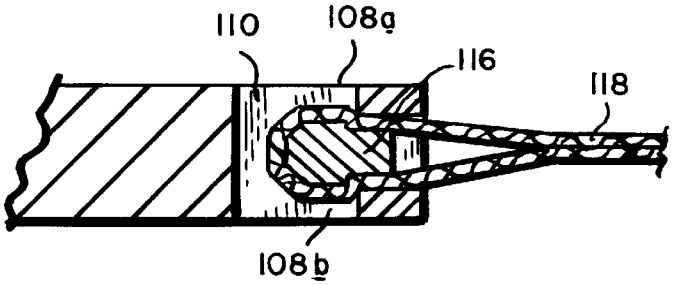
FIG. 8 is a side sectional view of FIG. 6 with the web in the locked position.

Referring to FIG. 8, when the strap 118 is under tension, the bar 112 is locked in position by frictional engagement, the strap under tension pulls the tongue 116 into the slot 106, the chamfered section 114 securing the strap against the access wall 104.

Figure 9:
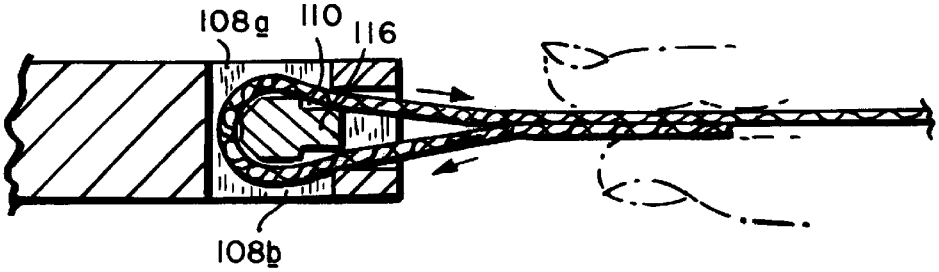
FIG. 9 is a side sectional view of FIG. 6 with the web in the unlocked adjustment position.

Referring to FIG. 9, when the strap 118 is to be adjusted, the strap 118 is grasped and moved rearwardly causing the bar 112 to move rearwardly. This, in essence, releases the strap within the slot 106 and the strap 118 may be manipulated such as by thumb and forefinger to adjust the strap.

In a further embodiment of the invention, referring to FIGS. 10, 11 and 12, (the buckle 10 is shown ergonomically enhanced) the cover 30 is characterized by a spring tab 90, which extend into the socket 32. When the secure part 60 slides into the socket 32, in addition to the locking action previously described, the end of the guide rail 76 engages and flexes (loads) the spring tab 90 such that both the spring tab 90 and guide rail 76 are engaged under tension (FIG. 12). When the buckle 10 is unlocked (as described above) the spring tab 90 flexes driving the guide rail 76 to facilitate the disengagement of the secure part 60 from the keeper 20.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described my invention, what I now claim is:

What is claimed is:

1. A two-piece lanyard release buckle which comprises:

a keeper having a floor which includes a front portion and a rear portion;

a cover spaced apart from the floor, the opposed surfaces defining a slot therebetween, a keeper surface formed on the surface of the cover;

means for flexibly securing the cover and the floor to one another;

a lanyard secured to the cover;

a secure part configured to be received in the slot, the secure part comprising a front portion and a rear portion, the secure part characterized by at least one locking finger, terminating in a catch tab, the locking finger having a top surface, whereby as the secure part is received in the keeper, the locking finger engages the keeper surface and locks the secure part to the keeper and when the buckle is unlocked the lanyard is pulled, the keeper surface moves, substantially unimpeded, upwardly over the plane of the top surface of the locking finger to release the keeper surface from the locking finger thereby unlocking the buckle.

2. The buckle of claim 1 which comprises:

means for flexibly securing the cover to the floor.

3. The buckle of claim 2 wherein there are two mirror image keeper surfaces formed on the opposed surface of the cover.

4. The buckle of claim 1 wherein there are a pair of mirror image locking fingers extending from the rear portion to the front portion of the secure part.

5. The buckle of claim 1 which comprises:

means for flexibly securing the locking finger to the secure part.

6. The buckle of claim 5 which comprises a guide rail formed between the locking fingers and extending from the rear portion to the front portion of the secure part.

7. The buckle of claim 1 wherein the secure part comprises a bottom plate formed integrally with the rear portion and the guide rail is secured to the bottom plate.

8. The buckle of claim 1 wherein the secure part comprises side walls extending from the rear portion which walls are adapted to be received in the slot in the keeper part.

9. The buckle of claim 1 which comprises:

means for securing a strap to the rear portion of the secure part.

10. The buckle of claim 9 wherein the means for securing the strap comprises a locking/adjustment system which includes:

an access wall characterized by a slot, top and bottom openings in registration with one another and side walls, the side walls and access walls defining a chamber, a clamping bar received in the chamber, a strap adapted to pass through the slot and around the clamping bar, the clamping bar with the attached strap adapted to reciprocate in the chamber between a locked position wherein the clamping bar and strap are frictionally engaged to the access wall and an adjustment position where the clamping bar is spaced apart from the access wall whereby the strap can be adjusted.

11. The buckle of claims 1 or 10 which comprises:

means for positively ejecting the secure part from the keeper.

12. The buckle of claim 11 wherein the means for positively ejecting comprises:

a spring tab formed in the keeper which spring tab is positively engaged by the secure part when the buckle is locked.

* * * * *